US005254448A

United States Patent [19]

Yamada et al.

[11] Patent Number: 5,254,448

[45] Date of Patent: Oct. 19, 1993

[54] LIGHT-SENSITIVE SILVER HALIDE PHOTOGRAPHIC MATERIAL

[75] Inventors: Taketoshi Yamada; Yasuhiko Takamuki; Youji Aritomi, all of Hino, Japan

[73] Assignee: Konica Corporation, Tokyo, Japan

[21] Appl. No.: 812,756

[22] Filed: Dec. 23, 1991

[30] Foreign Application Priority Data

Jan. 8, 1991 [JP] Japan ..... 3-656
Feb. 4, 1991 [JP] Japan ..... 3-33401

[51] Int. Cl.[5] ..... G03C 1/76

[52] U.S. Cl. ..... 430/523; 430/527; 430/529; 430/630; 430/961

[58] Field of Search ..... 430/529, 530, 523, 950, 430/961, 527

[56] References Cited

U.S. PATENT DOCUMENTS

| | | | |
|---|---|---|---|
| 3,754,924 | 8/1973 | De Geest et al. . | |
| 3,874,879 | 4/1975 | Rasch | 430/530 |
| 4,330,618 | 5/1982 | Minamiza et al. | 430/529 |
| 4,335,201 | 6/1982 | Miller et al. | 430/529 |
| **4,347,308** | 8/1982 | Takeuchi et al. | 430/529 |
| 4,366,238 | 12/1982 | Yokoyama et al. | 430/529 |
| 4,394,441 | 7/1983 | Kawaguchi et al. | 430/530 |
| 4,847,187 | 6/1989 | Ono et al. | 430/529 |
| 4,891,326 | 1/1990 | Yokoyama et al. | 430/529 |
| 4,975,363 | 12/1980 | Cavallo | 430/950 |
| 5,122,445 | 6/1992 | Ishigaka | 430/590 |

FOREIGN PATENT DOCUMENTS

| | | |
|---|---|---|
| 0402774 | 12/1990 | European Pat. Off. . |
| 2095561 | 2/1972 | France . |
| 2070267 | 9/1981 | United Kingdom . |
| 2075208 | 11/1981 | United Kingdom . |

OTHER PUBLICATIONS

Research Disclosure No. 312, Apr. 1990, pp. 312–314, Emsworth, GB; J. Berendsen et al.: "Backing layers with antistatic agent" *p. 313, first paragraph; example 1*.

Patent Abstracts of Japan vol. 14, No. 150 (P-1025)(4093), Mar. 22, 1990; & JP-A-212145 (Fuji Photo Film Co).

*Primary Examiner*—Jack P. Brammer

*Attorney, Agent, or Firm*—Frishauf, Holtz, Goodman & Woodward

[57] ABSTRACT

Disclosed is a silver halide photographic light-sensitive material that comprises a support having thereon a conductive layer containing a water-soluble polymer or a metal oxide and a photographic component layer having at least one surface active agent containing a fluorine compound. The silver halide photographic light-sensitive material according to this invention does not cause any deterioration of antistatic properties even after photographic processing, also does not cause any faulty transport even when used in the automatic transport apparatus comprising a transport path having a surface coated with Teflon, and not tends to cause flaws even after raw stock.

10 Claims, No Drawings

LIGHT-SENSITIVE SILVER HALIDE PHOTOGRAPHIC MATERIAL

FIELD OF THE INVENTION

The present invention relates to a light-sensitive silver halide photographic material having an antistatic layer.

BACKGROUND OF THE INVENTION

In general, plastic films so strongly tend to be statically charged that their use may be greatly restricted in many instances. For example, in the case of light-sensitive silver halide photographic materials, supports made of polyethylene terephthalate are commonly used, which tend to be statically charged particularly under conditions of low humidity as in the winter. In instances in which high-speed photographic emulsions are coated at a high speed as in nowadays, it is particularly important to take a countermeasure for antistatic.

Once a light-sensitive material has been statically charged, static marks may occur because of release of the stored energy, or foreign matter such as dust may be attracted. This may cause occurrence of pinholes, resulting in a serious deterioration of product quality, and an attempt for its restoration brings about a great lowering of workability. For this reason, antistatic agents are commonly used in light-sensitive materials. Nowadays, cationic surface active agents, amphoteric surface active agents, surface active agents or polymeric compounds having a polyethylene oxide group, polymers having a sulfonic acid or phosphoric acid group in the molecule, etc. are used.

In such conventional techniques, however, antistatic properties may be greatly deteriorated when photographic processing is carried out. This is presumed to be due to a loss of antistatic properties as a result of the processing carried out through the steps such as developing using an alkali, fixing in an acidic environment, and washing. Hence, problems may arise such that pinholes are produced because of adhesion of dust in such an instance in which a film having been processed is further brought to printing as in the case of printing light-sensitive materials. Taking account of such problems, Japanese Patent Publications Open to Public Inspection (hereinafter referred to as Japanese Patent O.P.I. Publication (s)) No. 84658/1980 and No. 174542/1986 propose to provide an antistatic layer comprising i) a water-soluble conductive polymer having a carboxyl group, ii) a hydrophobic polymer having a carboxyl group and iii) a polyfunctional aziridine. This method makes it possible to retain antistatic properties even after the processing. This method, however, has a disadvantage when applied in an automatic transport apparatus comprising a transport path having a surface coated with Teflon, as is seen in a certain kind of scanners, where providing such an antistatic layer causes accumulation of static charges on the surface coated with Teflon, during the transport of light-sensitive materials, to cause faulty transport, i.e., wrong transport and output of light-sensitive materials. The method also has a disadvantage that providing such an antistatic layer tends to cause flaws after raw stock.

SUMMARY OF THE INVENTION

To overcome the above problems, an object of the present invention is to provide a light-sensitive silver halide photographic material that may cause no deterioration of antistatic properties even after photographic processing, also may cause no faulty transport even when used in the automatic transport apparatus comprising a transport path having a surface coated with Teflon, and not tends to cause flaws even after raw stock.

The above object of the present invention can be achieved by a light-sensitive silver halide photographic material comprising a support, and provided thereon i) a conductive layer containing a water-soluble polymer or a metal oxide and ii) a photographic component layer having at least one surface active agent-containing fluorine.

DETAILED DESCRIPTION OF THE INVENTION

The present invention will be described below in detail.

The conductive layer in the present invention can be formed using a water-soluble conductive polymer or a metal oxide.

The water-soluble conductive polymer can form a transparent layer even when used alone, but may cause cracking of the layer because of even a slight divergence of drying conditions. In the constitution of the present invention, hydrophobic polymer particles are used to prevent such cracking, which bring about a great effect.

The water-soluble conductive polymer of the present invention may include polymers having at least one conductive group selected from a sulfonic acid group, a sulfuric acid ester group, a quaternary ammonium salt group, a tertiary ammonium salt group, a carboxyl group and a polyethylene oxide group. Of these groups, a sulfonic acid group, a sulfuric acid ester group and a quaternary ammonium salt group are preferred. The conductive group must be in an amount of not less than 5% by weight per mol of the polymer. The water-soluble conductive polymer contains a carboxyl group, a hydroxyl group, an amino group, an epoxy group, an aziridine group, an active methylene group, a sulfine group, an aldehyde group or a vinyl sulfone group, among which a carboxyl group, p hydroxyl group, an amino group, an epoxy group, an aziridine group and an aldehyde group are preferred. Any of these groups must be in an amount of not less than 5% by weight per mol of the polymer. The polymer may have a molecular weight of from 3,000 to 100,000, and preferably from 3,500 to 50,000.

Exemplary compounds of the water-soluble conductive polymer used in the present invention are shown below. Examples are by no means limited to these.

Homopolymer A-1

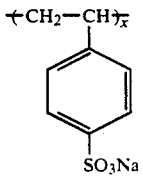

Mn = 60.000

-continued
Homopolymer A-2
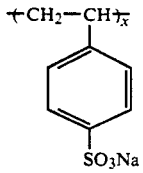
Mn = 70,000
A-3
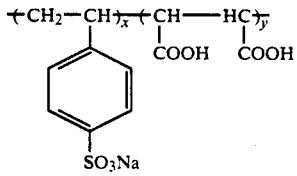
X:Y = 75:25
Mn = 5,000
A-4
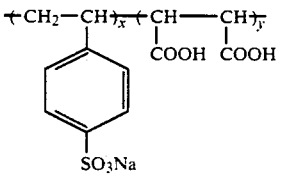
X:Y = 50:50
Mn = 12,000
A-5
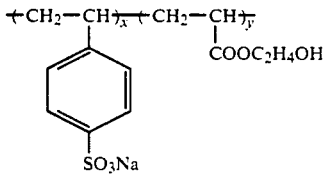
x:y = 70:30
Mn = 5,000
A-6
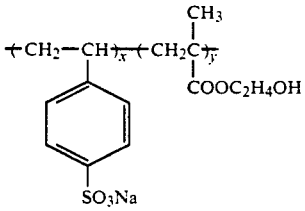
x:y = 90:10
Mn = 10,000
A-7
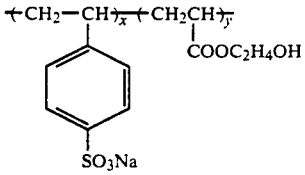
x:y = 60:40
Mn = 7,000
A-8
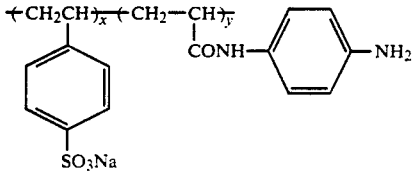
x:y = 90:10
Mn = 15,000
-continued
A-9
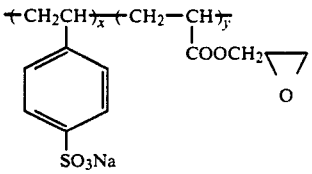
x:y = 60:40
Mn = 5,000
A-10
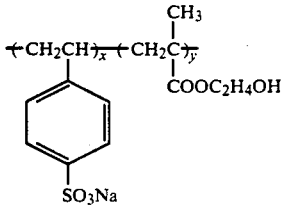
x:y = 90:10
Mn = 20,000
A-11
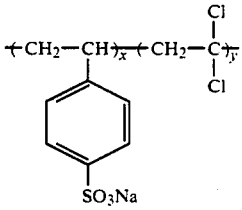
x:y = 97:3
Mn = 30,000
A-12
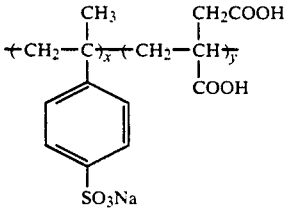
x:y = 98:2
Mn = 5,000
A-13
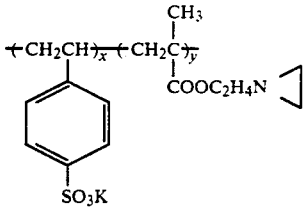
x:y = 60:40
Mn = 8,000
A-14
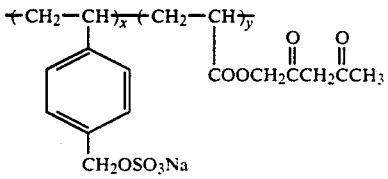
x:y = 95:5
Mn = 25,000

-continued
A-15
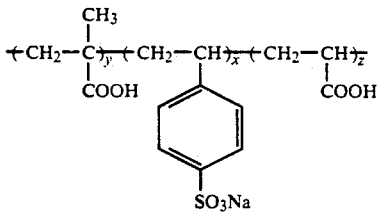
x:y:z = 80:19:1
Mn = 5,000
A-16
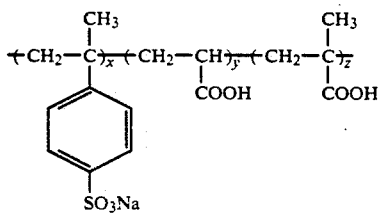
x:y:z = 70:28:2
Mn = 6,000
A-17
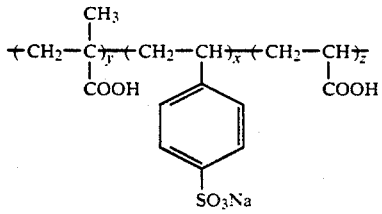
x:y:z = 85:13:2
Mn = 8,000
A-18
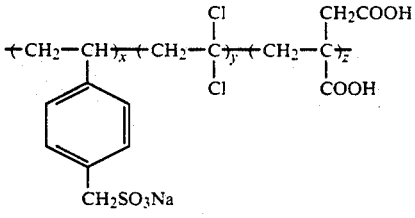
x:y:z = 80:16:4
Mn = 10,000
A-19
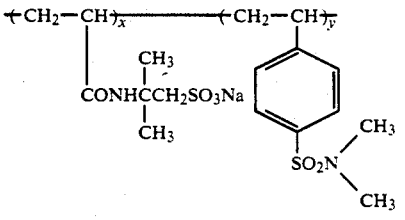
x:y = 90:10
Mn = 30,000
A-20
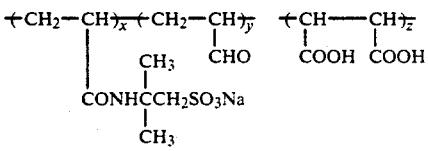
x:y:z = 85:10:5
Mn = 10,000
-continued
A-21
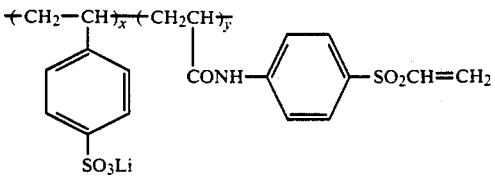
x:y = 90:10
Mn = 6,000
A-22
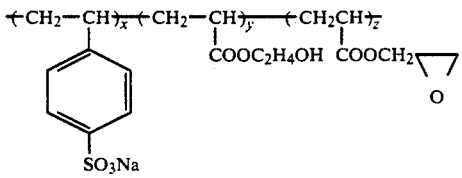
x:y:z = 80:10:10
Mn = 15,000
A-23
Dextran sulfate
Degree of substitution: 2.0, M = 100,000
A-24
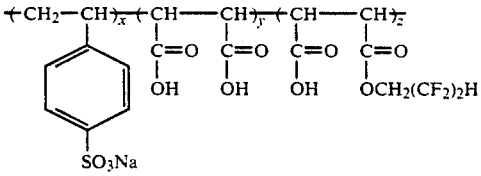
x:y:z = 50:40:10
Mn = 100,000
A-25
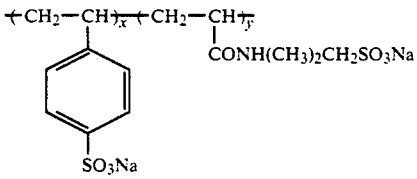
x:y = 80:20
Mn = 50,000
A-26
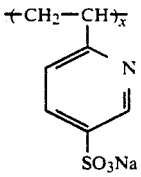
Mn = 100,000
A-27
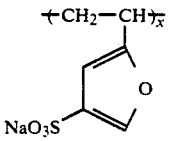
Mn = 20,000
A-28
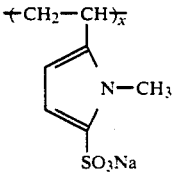
Mn = 20,000

-continued
A-29
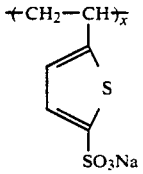
Mn = 150,000
A-30
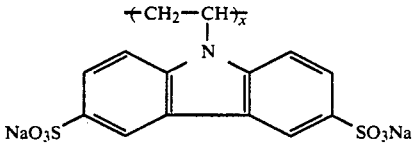
Mn = 300,000
A-31
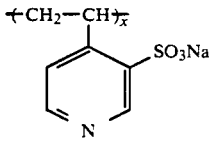
Mn = 280,000
A-32
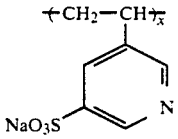
Mn = 50,000
A-33
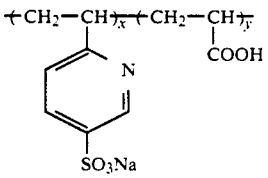
x:y = 60:40
Mn = 80,000
A-34
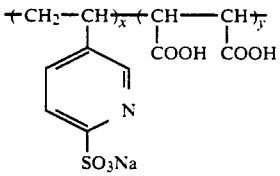
x:y = 70:30
Mn = 5,000
A-35
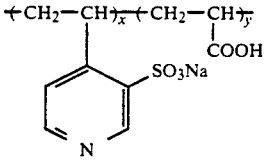
x:y = 80:20
Mn = 50,000
A-36
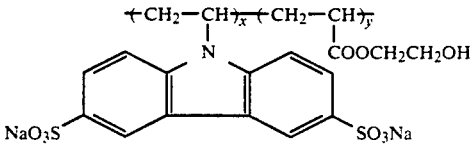
x:y = 75:25
Mn = 40,000
-continued
A-37
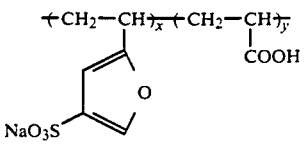
x:y = 80:20
Mn = 60,000
A-38
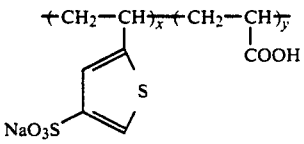
x:y = 90:10
Mn = 40,000
A-39
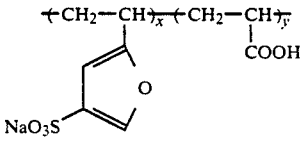
x:y = 55:45
Mn = 20,000
A-40
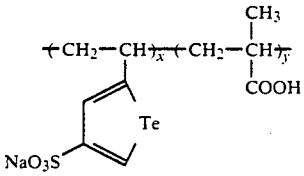
x:y = 90:10
Mn = 60,000
A-41
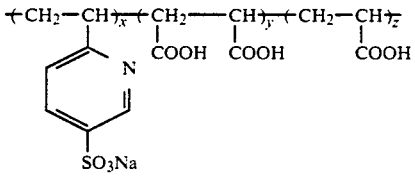
x:y:z = 80:10:10
Mn = 10,000
A-42
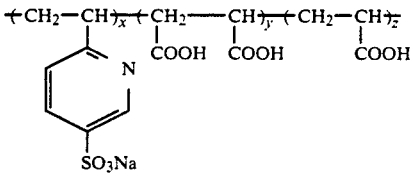
x:y:z = 70:25:5
Mn = 30,000
A-43
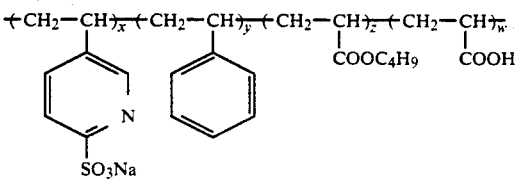
x:y:z:w = 60:30:8:2
Mn = 50,000

-continued

A-44

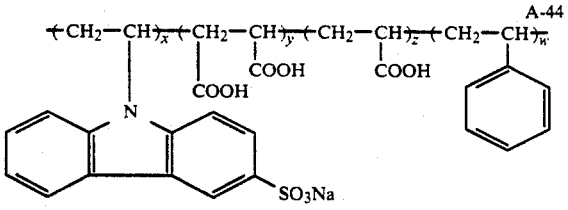

x:y:z:w = 50:30:10:10
Mn = 60,000

A-45

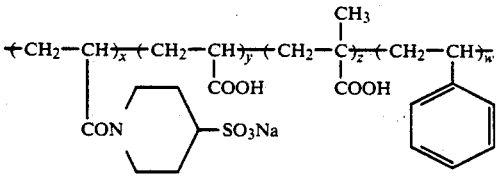

x:y:z:w = 40:30:20:10
Mn = 50,000

A-46

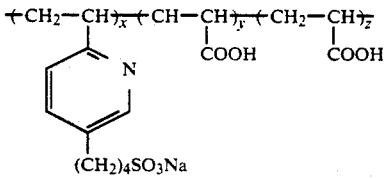

x:y:z = 60:30:10
Mn = 30,000

A-47

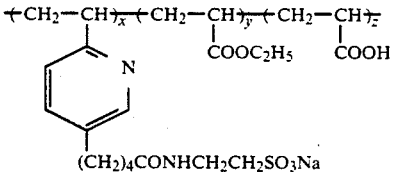

x:y:z = 80:5:15
Mn = 50,000

A-48

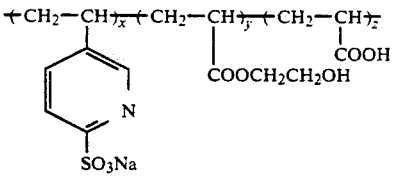

x:y:z = 55:35:10
Mn = 30,000

A-49

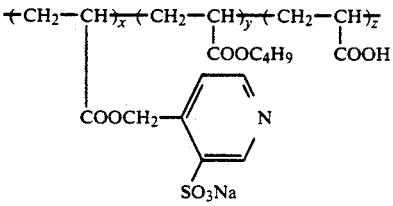

x:y:z = 50:10:40
Mn = 60,000

-continued

A-50

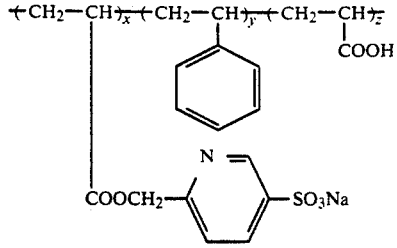

x:y:z = 60:10:30
Mn = 60,000

In the above compounds A-1 to A-50, x, y and z each represent mol % of the monomer component, and Mn represents an average molecular weight (In the present specification, the average molecular weight refers to the number average molecular weight.

These polymers are commercially available or can be synthesized by polymerizing monomers obtained by conventional methods. Any of these compounds may preferably be added in an amount of from 0.01 to 10 $g/m^2$, and particularly preferably from 0.1 to 5 $g/m^2$.

These compounds may be used alone or in the form of mixture with various types of hydrophilic binder or hydrophobic binder, to form a layer. As the hydrophilic binder, gelatin or polyacrylamide may be particularly advantageously used. As other binders, the binder may include colloidal albumin, cellulose acetate, cellulose nitrate, polyvinyl alcohol, hydrolyzed polyvinyl acetate and phthalated gelatin. The hydrophobic binder may include polymers having a molecular weight of from 20,000 to 1,000,000 or more, as exemplified by a styrene/butyl acrylate/acrylic acid terpolymer, a butyl acrylate/acrylonitrile/acrylic acid terpolymer and a methyl methacrylate/ethyl acrylate/acrylic acid terpolymer.

As for the hydrophobic polymer particles contained in the water-soluble conductive polymer of the present invention, they are a latex substantially insoluble in water. This hydrophobic polymer can be obtained by copolymerizing monomers selected from styrene, styrene derivatives, alkyl acrylates, alkyl methacrylates, olefin derivatives, ethylene halide derivatives, acrylamide derivatives, methacrylamide derivatives, vinyl ester derivatives, acrylonitrile, etc., in any desired combination. In particular, those containing at least 30 mol % of a styrene derivative, an alkyl acrylate or an alkyl methacrylate are preferred. Those containing at least 50 mol % are particularly preferred.

In order to form the hydrophobic polymer into a latex, two methods are available, one of which is emulsion polymerization and the other of which is a dispersion method wherein a polymer in a solid state is dissolved in a low-boiling solvent and then finely dispersed, followed by evaporation of the solvent. The emulsion polymerization is preferred in view of the advantage that particles with a fine, and uniform particle size can be produced.

As a surface active agent used in the emulsion polymerization, it is preferred to use an anionic surface active agent or a nonionic surface active agent, which may preferably be used in an amount of not more than 10% by weight based on the monomers. Use of the surface active agent in an excessively large amount may cause clouding of the conductive layer.

The hydrophobic polymer may have a molecular weight of not less than 3,000. Little difference in transparency is brought about from a difference in molecular weight.
Examples of the hydrophobic polymer of the present invention are shown below.
B-1
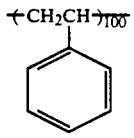
B-2
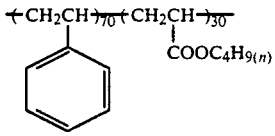
B-3
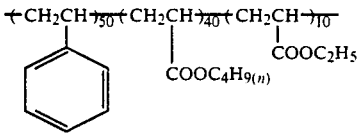
B-4
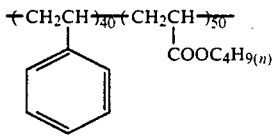
B-5
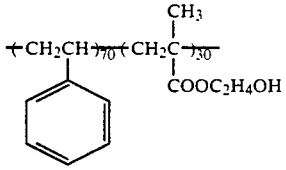
B-6
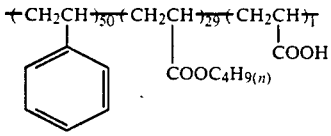
B-7
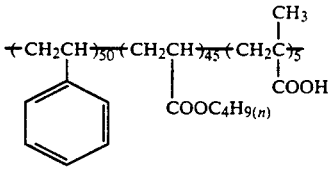
B-8
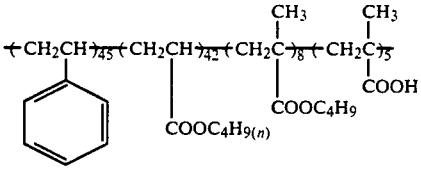
B-9
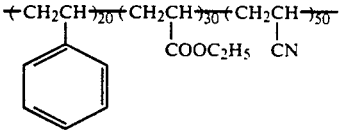
-continued
B-10
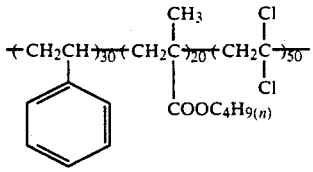
B-11
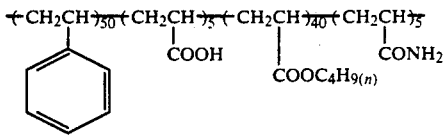
B-12
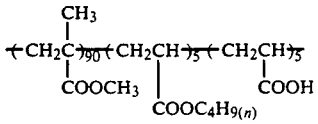
B-13
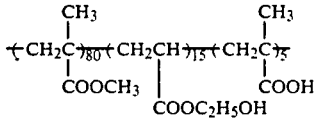
B-14
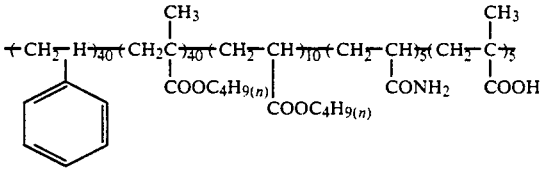
B-15
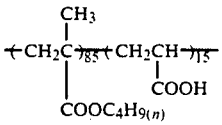
B-16
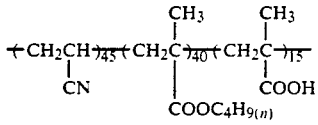
B-17
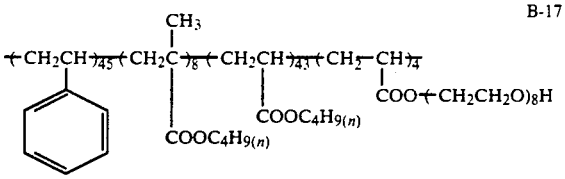
B-18
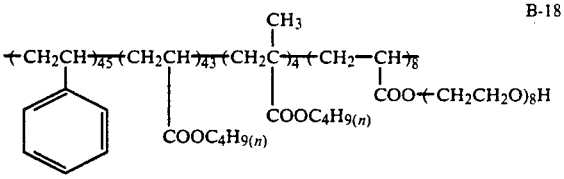
B-19
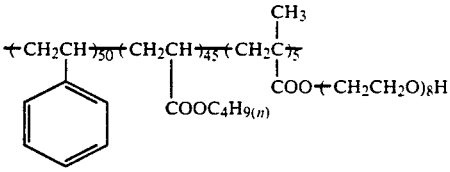

-continued

B-20

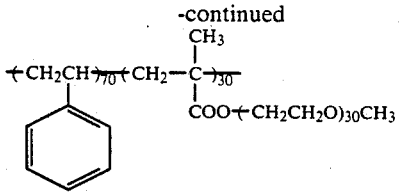

B-21

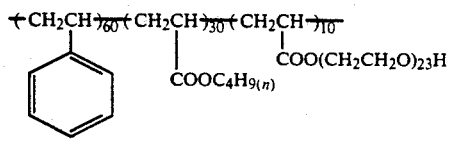

B-22

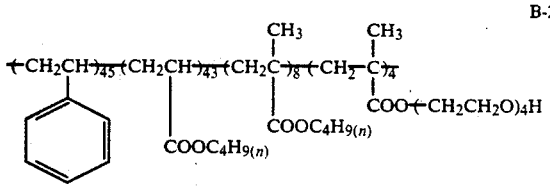

B-23

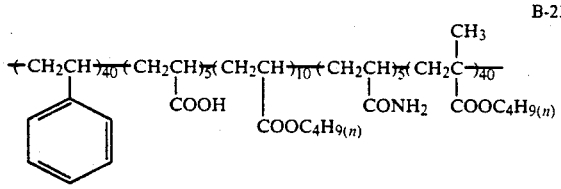

As the surface active agent used in the above emulsion polymerization, or the dispersing agent used in the dispersion method, a nonionic surface active agent may be used, and a polyalkylene oxide compound may preferably be used.

The polyalkylene oxide compound refers to a compound containing at least 3 and at most 500 polyalkylene oxide chains in its molecule. The compound can be synthesized, for example, by condensation reaction of a polyalkylene oxide with a compound having an active hydrogen atom, such as an aromatic alcohol, a phenol, a fatty acid, an aliphatic mercaptan or an organic amine, or by condensation reaction of a polyol such as polypropylene glycol or a polyoxytetramethylene polymer with an aromatic mercaptan, an organic amine, ethylene oxide or propylene oxide.

The above polyalkylene oxide compound need not be those having the polyalkylene oxide chains in a single series, and may be a block copolymer with the chains divided into two or more sections. Here, the polyalkylene oxide may preferably have a total degree of polymerization of not less than 3 and not more than 100.

The above polyalkylene oxide compound optionally used in the present invention can be exemplified by those disclosed, for example, in Japanese Patent O.P.I. Publication No. 65831/1990.

A hardening agent can be used in the conductive layer. The hardening agent may preferably be a hydroxyl group-containing epoxy hardening agent. It may more preferably be a reaction product of a polyglycidol represented by the following Formula 6 with an epihalohydrin. This can be considered to be a mixture on account of its synthesis method. Whether or not it is a mixture, however, is not important since the effect of the present invention can be attained by controlling the number of hydroxyl groups and the number of epoxy groups. Thus, the hardening agent may be in the form of either a single body or a mixture.

Examples thereof may include the following. As a matter of course, examples are by no means limited to these.

Reaction products of the compound of Formula 6 with an epihalohydrin:

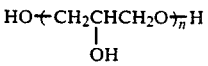

Formula 6

Addition reaction product of 4 mol epichlorohydrin CA-2 n=6

Addition reaction product of 4 mol epichlorohydrin CA-3 N=3

Addition reaction product of 3 mol epichlorohydrin CA-4 N=8

Addition reaction product of 6 mol epichlorohydrin CA-5 N=5

Addition reaction product of 3 mol epiiodohydrin CA-6 N=10

Addition reaction product of 8 mol epiiodohydrin

The hardening agent that can be used in the conductive layer may also include a compound represented by the following Formula 7.

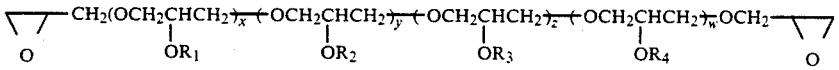

Formula 7

In the formula, x, y, z and w each represent an integer of 0 to 50; $R_1$, $R_2$, $R_3$ and $R_4$ each represent a hydrogen atom or a group represented by the following Formula 8.

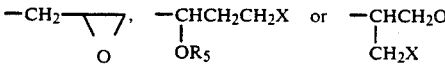

Formula 8

$R_1$, $R_2$, $R_3$ and $R_4$ may be the same or different. X represents a halogen atom; and $R_5$ and $R_6$ each represent a hydrogen atom or the epoxy group previously set forth.

Examples of the compounds represented by Formula 7 and Formula 8 are shown below, which are compounds disclosed in Japanese Patent Application No. 65831/1990.

CB-1

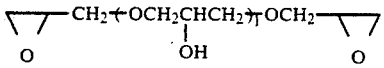

CB-2

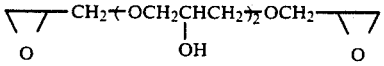

-continued
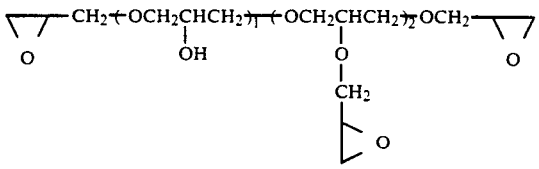
CB-3
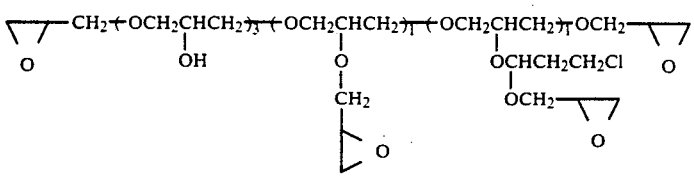
CB-4
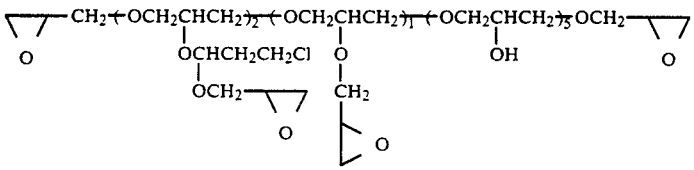
CB-5
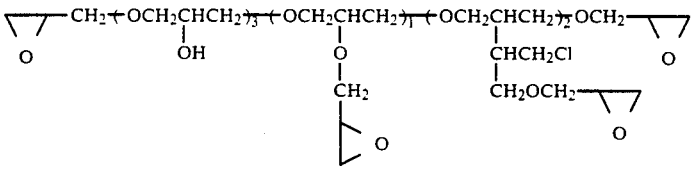
CB-6
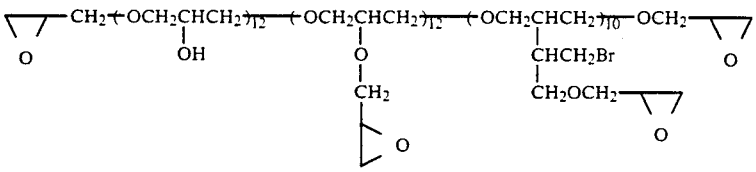
CB-7
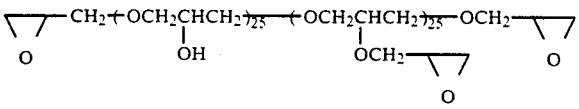
CB-8
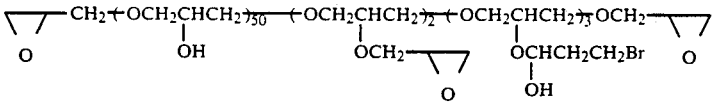
CB-9
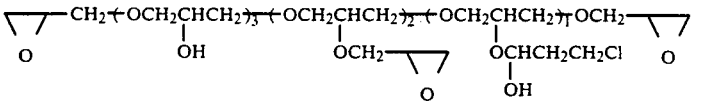
CB-10
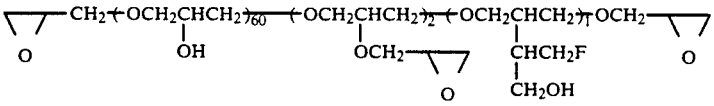
CB-11
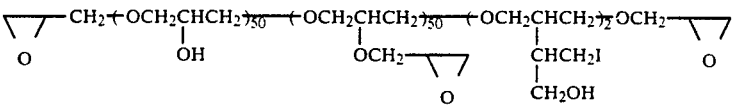
CB-12

-continued

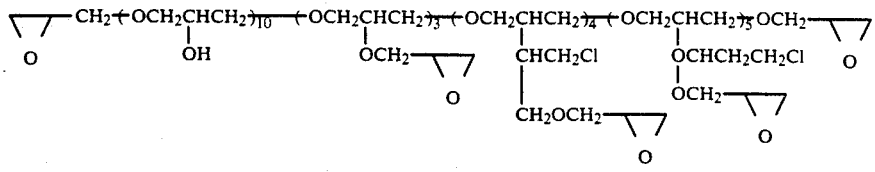

CB-13

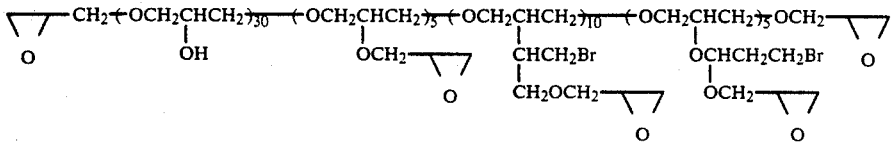

CB-14

The reaction products represented by Formula 6 and the compound represented by Formula 7 may each be dissolved in an organic solvent such as alcohol or acetone and then the solution may be added as it is. Alternatively, they may be added after they have each been dispersed using a surface active agent such as a nonylphenoxyalkylene oxide.

The compound represented by Formula 6 or Formula 7 may preferably be added in an amount of from 1 to 1,000 g/m$^2$.

A method of forming the conductive layer by the use of the metal oxide will be described below.

Those which are preferable as the metal compound are crystalline metal oxide particles. Stated generally, those containing an oxygen deficiency and those containing a small quantity of different kind of atoms capable of forming a doner with respect to the metal oxide used are highly conductive, and hence particularly preferred. In particular, the latter ones containing a small quantity of different kind of atoms capable of forming a doner with respect to the metal oxide used are preferred since they give no fogging of silver halide emulsions.

The metal compounds are preferably exemplified by $ZnO_2$, $TiO_2$, $SnO_2$, $Al_2O_3$, $In_2O_3$, $SiO_2$, MgO, BaO, $MoO_3$ and $V_2O_5$, or a composite oxide of any of these. In particular, $ZnO_2$, $TiO_2$ and $SnO_2$are preferred.

As examples containing different kind of atoms, it is effective to add Sb to SnO, or to add Nb, Ta or the like to $TiO_2$. These different kind of atoms may be added in an amount ranging from 0.01 to 30 mol %, and particularly preferably ranging from 0.1 to 10 mol %.

The particles of the metal oxide used in the present invention may preferably be conductive and have a volume resistivity of not more than $10^7$ Ω·cm, and particularly preferably not more than $10^5$ Ω·cm.

This oxide is disclosed in Japanese Patent O.P.I. Publications No. 143431/1981, No. 120519/1981, No. 62647/1983, etc.

The metal oxide particles, when used, are dispersed or dissolved in a binder. There are no particular limitations on the binder that can be used, so long as it is capable of forming a film. It may include, for example, proteins such as gelatin and casein; cellulose compounds such as carboxymethyl celluloe, hydroxyethyl cellulose, acetyl cellulose, diacetyl cellulose and triacetyl cellulose; saccharides such as dextran, agar, sodium alginate and starch derivatives; and synthetic polymers such as polyvinyl alcohol, polyvinyl acetate, polyacrylate, polymethacrylate, polystyrene, polyacrylamide, poly-N-vinyl pyrrolidone, polyester, polyvinyl chloride and polyacrylic acid.

In particular, gelatin such as lime-treated gelatin, acid-treated gelatin, enzymatic process gelatin, phthalated gelatin or acetylated gelatin, acetyl cellulose, diacetyl cellulose, triacetyl cellulose, polyvinyl alcohol, polyvinyl acetate, polybutyl acrylate, polyacrylamide and dextran are preferred.

In order to more effectively use the metal oxide to lower the resistance of the conductive layer, it is more preferable for the conductive layer to have the metal oxide in a higher volume content. In order for the layer to have a sufficient strength, the layer must contain at least 5% of binder, and hence the metal oxide may preferably be in a volume percentage ranging from 5 to 95%.

The metal oxide may preferably be used in an amount of from 0.005 to 10 g/m$^2$, and more preferably from 0.01 to 5 g/m$^2$, whereby the antistatic properties can be obtained.

In the present invention, the conductive layer is provided between a silver halide emulsion layer and a support, and/or on the side of the support opposite to the emulsion layer side. More specifically, it may be provided on the light-sensitive emulsion side of the transparent support, or may be provided on the side of the transparent support opposite to the light-sensitive emulsion side, i.e., what is called the back side.

The fluorine-containing surface active agent used in the present invention can be represented by the following Formula Fa, Fb, Fc, Fd or Fe.

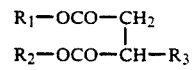

Formula Fa

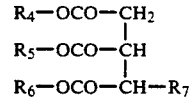

Formula Fb

In the formulas, $R_1$, $R_2$, $R_4$, $R_5$ and $R_6$ each represent a straight-chain or branched alkyl group having 1 to 32 carbon atoms, as exemplified by a methyl group, an ethyl group, a butyl group, an isobutyl group, a pentyl group, a hexyl group, an octyl group, a nonyl group, a decyl group, a dodecyl group and an octadecyl group, which may also be an alkyl group that forms a ring. At least one group of $R_1$ and $R_2$ and at least one group of $R_4$, $R_5$ and $R_6$ are each substituted with at least one fluorine atom. $R_1$, $R_2$, $R_4$, $R_5$and $R_6$ may also each represent an aryl group as exemplified by a phenyl group and a naphthyl group. In these aryl groups, at least one group of $R_1$ and $R_2$ and at least one group of $R_4$, $R_5$ and $R_6$ are each substituted with a group substituted with at least one fluorine atom.

$R_3$ and $R_7$ each represent a carboxylato group, a sulfonato group or an acid group such as a phosphoric acid group.

Formula Fc

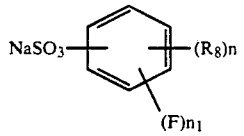

In the formula, $R_8$ represent an alkyl group having 1 to 32 carbon atoms, as exemplified by a methyl group, an ethyl group, a propyl group, a hexyl group, a nonyl group, a dodecyl group and an hexadecyl group. These groups are each substituted with at least one fluorine atom. Letter symbol n represents an integer of 1 to 3, and $n_1$ represents an integer of 0 to 4.

Formula Fd

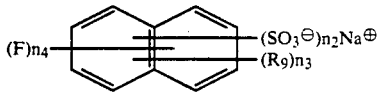

In the formula, $R_9$ represents a saturated or unsaturated straight-chain or branched alkyl group having 1 to 32 carbon atoms, as exemplified by a methyl group, an ethyl group, a butyl group, an isobutyl group, a hexyl group, a dodecyl group and an octadecyl group. The unsaturated alkyl group can be exemplified by an aryl group a butenyl group and an octenyl group. These saturated or unsaturated alkyl groups are each substituted with at least one fluorine atom. Letter symbols $n_2$ and $n_3$ each represent an integer of 1 to 3, and $n_4$ represent an integer of 0 to 6.

Formula Fe

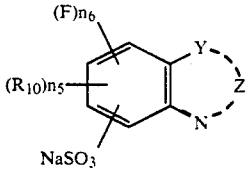

In the formula, Y represents a sulfur atom, a selenium atom, an oxygen atom, a nitrogen atom or a group $-N(R_{11})-$, wherein $R_{11}$ represents a hydrogen atom or an alkyl group having 1 to 3 carbon atoms, as exemplified by a methyl group and an ethyl group; $R_{10}$ represents a group having the same definition as the group represented by $R_8$ in Formula Fc previously set out, or an aryl group, as exemplified by a phenyl group or a naphthyl group, substituted with at least one fluorine atom. Z represents a group of atoms necessary to complete a hetero ring of 5 or 6 members, which can be exemplified by a thiazole ring, a selenazole ring, an oxazole ring, an imidazole ring, a pyrazole ring, a triazole ring, a tetrazole ring, a pyrimidine ring and a triazine ring.

The above hetero ring may further have a substituent such as an alkyl group or an aryl group, and on these substituents each a fluorine atom may be substituted.

Examples of the fluorine-containing surface active agent represented by the above Formulas Fa to Fe are shown below. Compounds usable in the present invention are by no means limited to these.

(Exemplary Compounds)

(F-1)

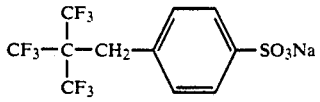

(F-2)

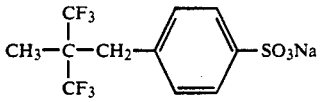

(F-3)

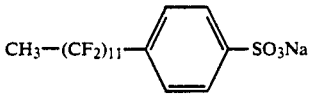

(F-4)

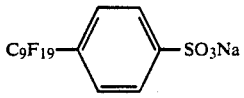

(F-5)

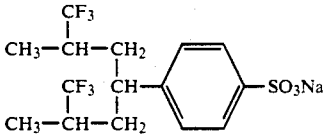

(F-6)

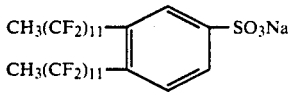

(F-7)

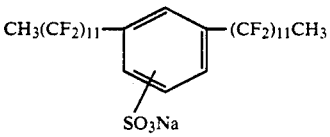

(F-8)

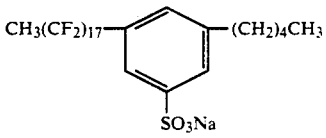

(F-9)

$CF_3C(CF_3)_2CF_2CF(CF_3)-CH_2OOCCH_2$
$CF_3C(CF_3)_2CF_2CF(CF_3)-CH_2OOCCH-SO_3Na$ (F-10)

$CF_3(CF_2)_{11}OOC-CH_2$
$CF_3(CF_2)_{11}OOC-CH-SO_3Na$ (F-11)

$CF_3(CF_2)_{17}OOC-CH_2$
$CF_3(CF_2)_{17}OOC-CHSO_3Na$ (F-12)

$CF_3(CF_2)_5OOCCH_2$
$CF_3(CF_2)_5OOCCH-SO_3Na$ (F-13)

$CF_3(CF_2)_3CF(C_2F_5)CF_2OOC-CH_2$
$CF_3(CF_2)_3CF(C_2F_5)CF_2OOC-CHSO_3Na$ (F-14)

$CF_3(CF_2)_9OOCCH_2$
$CF_3(CF_2)_4OOCCH-SO_3Na$ (F-15)

$C_6F_6OCOCH_2$
$C_6F_5OCOCH-SO_3Na$

-continued (Exemplary Compounds)

$CHF_2(CF_2)_6-CH_2OOCCH_2$
$CHF_2(CF_2)_6-CH_2OOCCH-SO_3Na$ (F-16)

$CHF_2(CF_2)_4-CH_2OOCCH_2$
$CHF_2(CF_2)_6-CH_2OOCCH-SO_3Na$ (F-17)

$CHF_2(CF_2)_6-CH_2OOCCH_2$
$CHF_2(CF_2)_4-CH_2OOCCH-SO_3Na$ (F-18)

$CHF_2(CF_2)_2CF(C_2F_5)CH_2OOC-CH_2$
$CHF_2(CF_2)_2CF(C_2F_5)CH_2OOC-CH-SO_3Na$ (F-19)

(F-20)

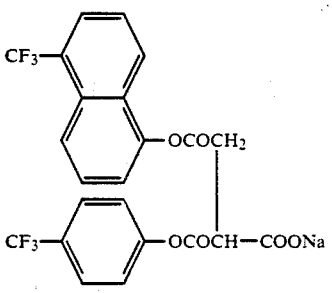

(F-21)

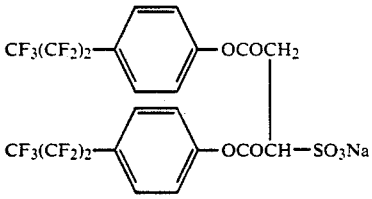

(F-22)

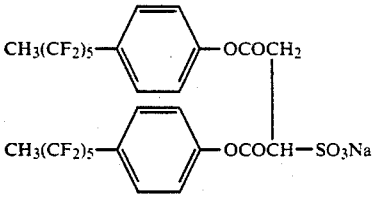

$CF_3(CF_2)_7-OOC-CH_2$
$CF_3(CF_2)_7-OOC-CH$
$CF_3(CF_2)_7-OOC-CH-SO_3Na$ (F-23)

(F-24)

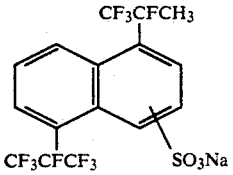

(F-25)

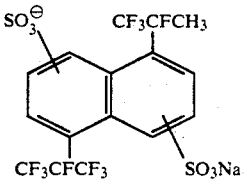

(F-26)

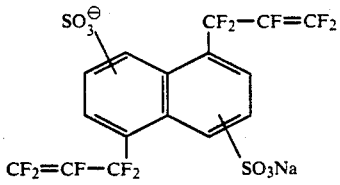

(F-27)

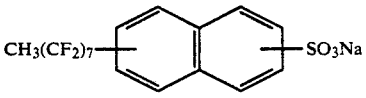

(F-28)

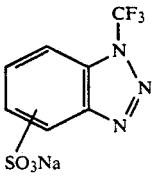

(F-29)

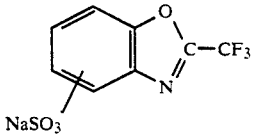

(F-30)

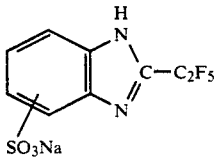

$H-(CF_2)_6CH_2-O-CH_2CH_2-SO_3Na$ (F-31)

$H(CF_2)_8CH_2-O-CH_2CH_2-SO_3Na$ (F-32)

$C_6F_5CH-OCH_2CH_2-SO_3Na$ (F-33)

$NaO_3SCH-COOCH_2(CF_2CF_2)_3H$
$CH_2COOC_5H_{11}(iso)$ (F-34)

$NaO_3S-CH-COOCH_2(CF_2CF_2)_3H$
$CH_2-COOCH_2CHC_4H_9$
$C_2H_5$ (F-35)

$NaO_3S-CH-COOCH_2(CF_2CF_2)_3H$
$CH_2COOCH_2-$ H (F-36)

$NaO_3S-CH-COOCH_2(CF_2CF_2)_4H$
$CH_2COOC_3H_7(n)$ (F-37)

$NaO_3S-CH-COOCH_7(CF_2CF_2)_7H$
$CH_2COOCH_3$ (F-38)

$NaO_3S-CHCOOCH_2CF_2CF_2H$
$CH_2COOC_{10}H_{21}(n)$ (F-39)

-continued (Exemplary Compounds)

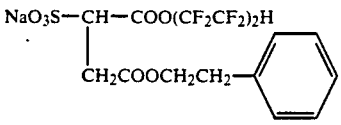
(F-40)

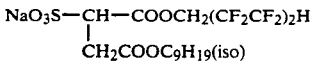
(F-41)

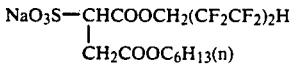
(F-42)

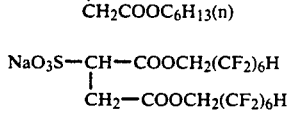
(F-43)

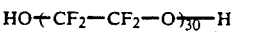
(F-44)

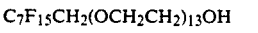
(F -45)

(F-46)

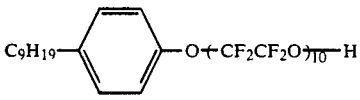

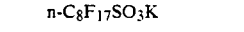
(F-47)

(F-48)

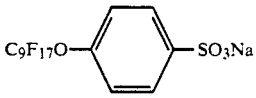

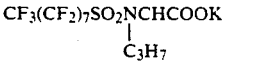
(F-49)

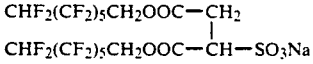
(F-50)

(F-51)

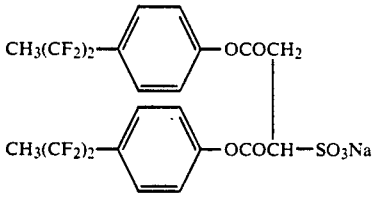

The fluorine-containing surface active agent used in the present invention may be incorporated in an amount of from 0.02 to 800 mg/m$^2$, and preferably from 0.05 to 300 mg/m$^2$.

The fluorine-containing surface active agent may preferably be added to the outermost layer of the light-sensitive material.

In the silver halide emulsion used in the present invention (hereinafter referred to as the silver halide emulsion, or merely as the emulsion), any silver halides can be used, as exemplified by silver bromide, silver iodobromide, silver iodochloride, silver chlorobromide and silver chloride, which are used in conventional silver halide emulsions. Preferred are silver chlorobromide containing not less than 60 mol % of silver chloride as used in negative silver halide emulsions, or silver chlorobromide, silver bromide or silver iodobromide containing not less than 10 mol % of silver bromide as used in positive silver halide emulsions.

Various techniques, additives and so forth which are known in the present industrial field can be used in the silver halide emulsion of the present invention.

For example, in the silver halide photographic emulsions used in the present invention and a backing layer, any of various kinds of chemical sensitizer, tone modifier, hardening agent, surface active agent, thickening agent, plasticizer, lubricant, development restrainer, ultraviolet absorbent, anti-irradiation dye, heavy metal, matting agent, etc. may be further incorporated by various methods. In the silver halide photographic emulsions used in the present invention and a backing layer, a polymer latex may also be incorporated.

The support that can be used in the light-sensitive silver halide photographic material of the present invention may be comprised of cellulose acetate, cellulose nitrate, polyesters such as polyethylene terephthalate, polyolefins such as polyethylene, polystyrene, barayta paper, polyolefin-coated paper, glass, metal, etc. These supports may be optionally subjected to subbing.

The light-sensitive silver halide photographic material according to the present invention, after exposure, can be photographically processed by various methods, for example, the methods conventionally used.

A black and white developing solution is an alkali solution containing a developing agent including hydroxybenzenes, aminophenols and aminobenzenes, and may contain other sulfite, carbonate, bisulfite, bromide or iodide of an alkali metal.

EXAMPLES

The present invention will be specifically described below by giving Examples.

Example 1

Preparation of support having conductive layer:

A support was provided with an antistatic layer (U-1) on the side opposite to the emulsion layer side, by previously subjecting the surface to corona discharging at a power of 30 W/(m$^2$·min), thereafter coating thereon a poly(styrene-butyl acrylate-glycidyl methacrylate) latex polymer in the presence of a hexamethylene aziridine hardening agent, and further coating thereon the following antistatic layer coating solution 1 so as to give the coating weights shown below, at a coating speed of 33 mm/min using a roll fit coating pan and an air knife, followed by drying at 90° C. for 2 minutes and then heating at 140° C. for 90 seconds. Support (I) was thus prepared.

| Antistatic layer coating solution 1 | |
|---|---|
| Water-soluble polymer of the invention (A) | 0.7 g/m$^2$ |
| Latex (B-14) | 0.2 g/m$^2$ |
| Polyethylene glycol (Mw: 5,965) | 600 mg/m$^2$ |
| Compound L | 100 mg/m$^2$ |

A support was provided with an antistatic layer (U-2) on the side opposite to the emulsion layer side, by previously subjecting the surface to corona discharging at a power of 30 W/(m$^2$·min), thereafter coating thereon a poly(acrylonitrile-vinylidene chloride-acrylic acid) latex polymer, and further coating thereon the following antistatic layer coating solution 2 so as to give the coating weights shown below, using a roll fit coating pan and an air knife, followed by drying at 100° C. for 5 minutes and then heating at 140° C. for 90 seconds. On this support, the following converting solution 3 was coated so as to give the coating weights shown below, followed by drying at 100° C. for 5 minutes. Support (II) was thus prepared. Similarly, the following converting solution 4 was coated on the same antistatic layer as U-2 to prepare support (III).

| Antistatic layer coating solution 2 | |
|---|---|
| Vanadium pentaoxide doped with silver | 2 mg/m$^2$ |
| Latex polymer: Vinylidene chloride/methyl acrylate/itaconic acid (83:15:2) copolymer | 6 mg/m$^2$ |
| Sodium 1-decyl-2-(3-isopentyl)succinato-2-sulfonate | 62.5 mg/m$^2$ |

| Converting solution 3 | |
|---|---|
| Latex polymer: A vinylidene chloride/methyl acrylate/itaconic acid (83:15:2) copolymer | 470 mg/m$^2$ |
| 1,3-Dioxan-2-one | 6 mg/m$^2$ |
| Sodium 1-decyl-2-(3-isopentyl)succinato-2-sulfonate | 35 mg/m$^2$ |

| Converting solution 4 | |
|---|---|
| Latex polymer: Vinylidene chloride/methyl acrylate/itaconic acid (88:10:2) copolymer | 470 mg/m$^2$ |
| Sodium 1-decyl-2-(3-isopentyl)succinato-2-sulfonate | 23 mg/m$^2$ |

Preparation of Silver Halide Emulsion A

A silver chloroiodide emulsion (62 mol % of silver chloride and 0.5 mol % of silver iodide per mol of silver) was prepared by double-jet precipitation. During this double-jet precipitation, potassium hexabromorhodate and potassium hexachloroiridate were added in amounts of $5\times10^{-8}$ mol per mol of silver and $5\times10^{-7}$ mol per mol of silver, respectively. Here, the potassium hexabromorhodate and potassium hexachloroiridate were added after grains with 5% of an end average grain size were formed and until they attained the end average grain size. Thereafter, the exemplary modified gelatin G-8 as disclosed in Japanese Patent O.P.I. Publication No. 45946/1991, page 4, left upper column was added. Thereafter, the solution was adjusted to pH 4.3 using acetic acid, followed by desalting washing, and then addition of gelatin to effect dissolution. In that stage, a mixture of the following compound components (a), (b) and (c) (the molar ratio of components (a), (b) and (c) is such that component (a):component (b):component (c)=50:46:4) were added in an amount of 40 mg per mol of silver halide contained in the emulsion.

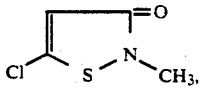

Component (a)

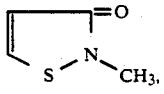

Componant (b)

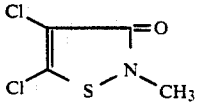

Component (c)

The emulsion thus obtained was a monodisperse emulsion comprised of cubic grains with an average grain size of 0.25 μm (variation coefficient: 10%).

Preparation of Emulsion Layer Coating Solution

To the above emulsion, citric acid and potassium bromide were added, and then chloroauric acid and sodium thiosulfate pentahydrate were added to effect ripening at 60° C. to give an optimum sensitivity. Thereafter, the following spectral sensitizers G3 and G4 were added in an amount of $2\times10^{-4}$ mol each, followed by addition of 50 mg of 1-phenyl-5-mercaptotetrazole and 1 g of 4-hydroxy-6-methyl-1,3,3a,7-tetrazaindene were added, both per mol of silver, and the ripening was stopped. To the emulsion obtained, 4 g of hydroquinone, 300 mg of 5-nitroindazole, 2 g of potassium bromide, 10 g of polymer latex P1 having the following structure, 2 g of a styrene/maleic acid copolymer, an aqueous 1N sodium hydroxide solution, sodium dodecylbenzenesulfonate as an addition aid, and 0.8 g of a sodium salt of 2,4-dichloro-6-hydroxytriazine as a hardening agent were added.

Preparation of Emulsion Layer Protective Film Coating Solution

To an aqueous solution containing 1.1 g of gelatin, 5.5 mg of 1-phenyl-4-hydroxymethyl-3-pyrazolidone, 25 mg of monodisperse silica with an an average particle diameter of 3 μm, and as coating aids an aqueous solution of 12 mg of sodium 1-decyl-2-(3-isopentyl)succinato-2-sulfonate, the fluorine-containing surface active agent as shown in the following Table 1 and citric acid were added, per 1 m$^2$ each, followed by stirring and further addition of formalin as a hardening agent.

Preparation of Backing Layer Coating Solution

To an aqueous solution containing 2.0 g of gelatin, 100 mg of water-soluble dye compound III-1 set forth later, 25 mg of ditto III-2, 100 mg of ditto III-3, 350 mg of polymer latex P-1, 60 mg of a styrene/maleic acid copolymer, 150 mg of colloidal silica, and as coating aids, 10 mg of sodium dodecylbenzene sulfonate, 10 mg of glyoxal and 55 mg of E-2 were added, per 1 m$^2$ each, followed by stirring.

Preparation of Backing Layer Protective Film Coating Solution

To an aqueous solution containing 1.0 g of gelatin, 12 mg of sodium 1-decyl-2-(3-isopentyl)succineto-2-sulfonate, 4 mg of a dispersion comprising monodisperse polymethyl methacrylate with an average particle diameter of 5.5 μm, and the fluorine-containing surface active agent as shown in the following Table 1 were added, per 1 m$^2$ each, followed by stirring and further addition of glyoxal and 0.8 g of sodium salt of 2,4-dichloro-6-hydroxytriazine as hardening agents.

G-3

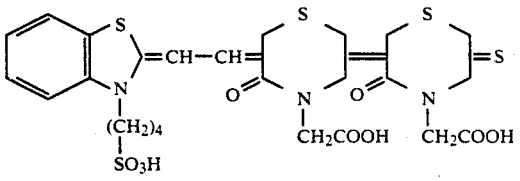

-continued

G-4

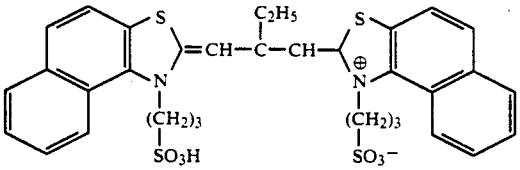

P-1

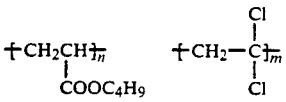

n:m = 50:50

Compounds used for the production of samples:

Compound III-1

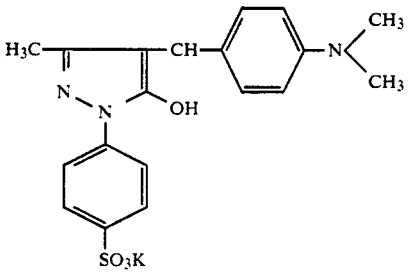

Compound III-2

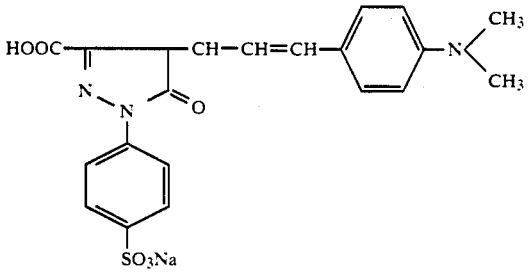

Compound III-3

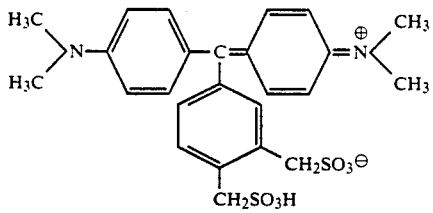

E-2

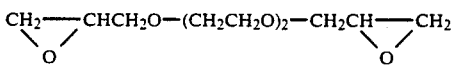

Production of Samples

Using the support having the above antistatic layer, corona discharging was applied at an energy of 15 W/(m²·min) to the support on its side on which U-1 or U-2 was present. Thereafter the backing layer coating solution and backing layer protective film coating solution prepared in the manner described above were coated. Corona discharging was also applied at an energy of 15 W/(m²·min) to the opposite side of the support. Thereafter the emulsion layer coating solution and emulsion layer protective film coating solution were coated. The emulsion layer coating solution was so coated as to give a silver weight of 4.0 mg/m² and a gelatin weight of 1.7 mg/m², followed by drying. On the resulting undeveloped samples thus obtained, transport performance in an automatic transport apparatus was evaluated.

Using also the developing solution and fixing solution as shown below, the samples were processed using an automatic processor GR-27 (trade name; manufactured by Konica Corporation), and thereafter the antistatic properties were examined.

The processing conditions were as shown below.

| Formulation of developing solution | |
|---|---|
| (Composition A) | |
| Pure water (ion-exchanged water) | 150 ml |
| Disodium ethylenediaminetetraacetate | 2 g |
| Diethylene glycol | 50 g |
| Potassium sulfite (aqueous 55% w/v solution) | 100 mi |
| Potassium carbonate | 50 g |
| Hydroquinone | 15 g |
| 5-Methyl benzotriazole | 200 mg |
| 1-Phenyl-5-mercaptotetrazole | 30 mg |
| Potassium hydroxide in the amount required for adjusting the pH of the solution used, to 10.4 | |
| Potassium bromide | 4.5 g |
| (Composition B) | |
| Pure water (ion-exchanged water) | 3 ml |
| Diethylene glycol | 50 g |
| 1-Phenyl-3-pyrazolidone | 500 mg |
| Disodium ethylenediaminetetraacetate | 25 mg |
| Acetic acid (aqueous 90% solution) | 0.3 ml |
| 5-Nitroindazole | 110 mg |

When the developing solution was used, the above composition A and composition B were dissolved in this order in 500 ml of water, and made up to 1 liter.

| Formulation of fixing solution | |
|---|---|
| (Composition A) | |
| Ammonium thiosulfate (aqueous 72.5% w/v solution) | 230 ml |
| Sodium sulfite | 9.5 g |
| Sodium acetate trihydrate | 15.9 g |
| Boric acid | 6.7 g |
| Sodium citrate dihydrate | 2 g |
| Acetic acid (aqueous 90% w/w solution) | 8.1 ml |
| (Composition B) | |
| Pure water (ion-exchanged water) | 17 ml |
| Sulfuric acid (aqueous 50% w/w solution) | 5.8 g |
| Aluminum sulfate (aqueous solution containing 8.1% w/w of aluminum in terms of $Al_2O_3$) | 26.5 g |

When the fixing solution was used, the above composition A and composition B were dissolved in this order in 500 ml of water, and made up to 1 liter. This fixing solution had a pH of about 4.3.

| Processing conditions | | |
|---|---|---|
| Steps | Temperature | Time |
| Developing | 34° C. | 15 seconds |
| Fixing | 34° C. | 15 seconds |
| Washing | Room temp. | 10 seconds |
| Drying | 40° C. | 10 seconds |

Each processing time includes what is called crossover transport time until the next step.

The undeveloped samples obtained were divided into two groups, one of which were stored at 23° C. and 55% RH for 3 days. The other remaining samples were moisture-conditioned at 23° C. and 55% RH for 3 hours, and thereafter enclosed in a moisture-proof bag in the state they were superposed one another, which were then stored at 55° C. for 3 days to make them undergo accelerated aging. Samples for aging were thus prepared, and their anti-flaw properties were compared.

Evaluation was made by the Following Methods.

Evaluation of Transport Performance in Automatic Transport Apparatus

The transport performance was evaluated using a scanner SG-747RU, manufactured by Dainippon Screen Mfg. Co., Ltd. Samples with a size of 609 mm×812 mm were automatically transported therethrough. An instance where a sample was normally outputted after exposure was evaluated as "A", and an instance where it was not normally outputted, as "B".

Evaluation of Antistatic Properties

Regarding the antistatic properties, test pieces having been processed were each rubbed 10 times with a Neoprene rubber roller. A piece of paper with a diameter of 5 mm was held up over this test piece, and the degree of attraction of the paper to the test piece was evaluated according to a five-rank system. A best instance was evaluated as "5", and a worst instance, as rank "1".

Evaluation of Anti-flaw Properties

Pieces having not been processed were rubbed 100 times against a Teflon plate under a load of 10 kg. The state of being flawed was evaluated according to a five-rank system. A best instance was evaluated as "5", and a worst instance, as rank "1".

Results obtained are shown in Table 1.

TABLE 1

| No. | Support | Conductive substance | Fluorine-containing surface active agent F: Emulsion layer protective film Kind | Emulsion layer protective film Amount | Backing layer protective film Kind | Backing layer protective film Amount | Transport performance* | Anti-static properties | Anti-flow properties Storage I | Anti-flow properties Storage II | Remarks |
|---|---|---|---|---|---|---|---|---|---|---|---|
| 1 | I | — | 3 | 0.5 mg/m² | — | — | A | 1 | 3 | 3 | X |
| 2 | " | A-1 | — | — | — | — | C | 3 | 2 | 1 | " |
| 3 | " | " | 3 | 0.5 mg/m² | — | — | A | 5 | 4 | 5 | Y |
| 4 | " | " | 6 | 0.1 mg/m² | — | — | A | 5 | 5 | 5 | " |
| 5 | " | " | 8 | 1.2 mg/m² | — | — | A | 5 | 5 | 5 | " |
| 6 | " | " | 9 | 2.1 mg/m² | — | — | A | 5 | 5 | 5 | " |
| 7 | " | " | 10 | " | — | — | A | 5 | 5 | 5 | " |
| 8 | " | " | 12 | " | — | — | A | 5 | 5 | 5 | " |
| 9 | " | A-2 | " | " | — | — | A | 5 | 5 | 5 | " |
| 10 | " | A-3 | " | " | — | — | A | 5 | 5 | 5 | " |
| 11 | " | " | " | " | 8 | 0.5 mg/m² | A | 5 | 5 | 5 | " |
| 12 | " | " | " | " | 9 | 1.2 mg/m² | A | 5 | 5 | 5 | " |
| 13 | I | A-3 | 12 | 2.1 mg/m² | 12 | 1.5 mg/m² | A | 5 | 5 | 5 | Y |
| 14 | " | " | 13 | " | — | — | A | 5 | 5 | 5 | " |
| 15 | " | " | 14 | " | — | — | A | 5 | 5 | 5 | " |
| 16 | " | " | 15 | " | — | — | A | 5 | 5 | 5 | " |
| 17 | I | " | 16 | 4.2 mg/m² | — | — | A | 5 | 5 | 5 | " |
| 18 | " | " | 17 | " | — | — | A | 5 | 5 | 5 | " |
| 19 | " | " | 18 | " | — | — | A | 5 | 4 | 4 | " |
| 20 | " | " | 19 | 8 mg/m² | — | — | A | 5 | 5 | 5 | " |
| 21 | " | " | 22 | 20 mg/m² | — | — | A | 5 | 4 | 4 | " |
| 22 | " | " | 29 | 0.08 mg/m² | — | — | A | 5 | 5 | 5 | " |
| 23 | " | " | 34 | 2.5 mg/m² | — | — | A | 5 | 5 | 5 | " |
| 24 | " | " | 47 | " | — | — | A | 5 | 5 | 5 | " |
| 25 | I | A-3 | 49 | 2.5 mg/m² | — | — | A | 5 | 5 | 5 | Y |
| 26 | " | MA | " | " | — | — | A | 5 | 5 | 5 | " |
| 27 | " | MA | " | " | 49 | 1.5 mg/m² | A | 5 | 5 | 5 | " |
| 28 | " | MB | " | " | — | — | A | 5 | 5 | 5 | " |
| 29 | II | MC | " | " | — | — | A | 5 | 5 | 5 | " |
| 30 | " | MC | " | " | 49 | 1.5 mg/m² | A | 5 | 5 | 5 | " |
| 31 | III | MC | " | " | — | — | A | 5 | 5 | 5 | " |
| 32 | " | MC | " | " | 49 | 1.5 mg/m² | A | 5 | 5 | 5 | " |

*in automatic transport apparatus
X: Comparative Example.
Y: Present Invention
Storage I: Measured after storage at 23° C., 55% RH for 3 days.
Storage II: Measured after storage in a moisture-proof bag at 55° C. for 3 days after moisture conditioning at 23° C., 55% RH for 3 days.
MA: 0.5 g/m² of fine stannic dioxide particles with an avergae particle diameter of 0.02 μm, doped with 1% antimony.
Mb: 0.5 g/m² of fine stannic dioxide particles with an average particle diameter of 0.03 μm, doped with 1% indium.
MC: 2 mg/m² of fine vanadium pentaoxide particles with an average particle diameter of 0.02 μm, doped with 2% silver.

As is clear from the results shown in Table 1, the samples according to the present invention cause no deterioration of antistatic properties even after processing such as developing. They also cause no faulty transport even in the automatic transport apparatus comprising a transport path having a surface coated with Teflon, and has a good anti-flaw properties even after raw stock.

Example 2

An emulsion layer coating solution and so forth were prepared to produce samples. (Preparation of coating solutions for an emulsion layer and a protective film formed above the emulsion layer)

| Solution A | |
|---|---|
| Water | 9.7 lit. |
| Sodium chloride | 20 g |

-continued

| | |
|---|---|
| Gelatin | 105 g |
| Solution B | |
| Water | 3.8 lit. |
| Sodium chloride | 94 g |
| Gelatin | 365 g |
| Potassium bromide | 450 g |
| Aqueous 0.01% solution of potassium hexachloroiridate | 28 ml |
| Aqueous 0.01% solution of potassium hexabromorhodate | 1.0 ml |
| Solution C | |
| Water | 3.8 lit. |
| Silver nitrate | 1,700 g |

To the above solution A, kept at a temperature of 40° C., the above solutions B and C were simultaneously added by accelerated flow rate precipitation over a period of 60 minutes while keeping pH and pAg at 3 and 7.7, respectively. The mixed solution was continuously stirred for further 10 minutes. Thereafter, the pH was adjusted to 6.0 with an aqueous sodium carbonate solution, and 2 liter of an aqueous 20% magnesium sulfate solution and 2.55 liter of an aqueous 5% polynaphthalenesulfonic acid solution were added. The emulsion was flocculated at 40° C., followed by decantation, and then washing with water to remove excess salt from the solution.

Next, to the resulting solution, 3.7 liter of water was added to carry out dispersion, and 0.9 liter of an aqueous 20% magnesium sulfate solution was again added, similarly followed by removal of excess salt from the solution. To the resulting solution, 3.7 liter of water and 141 g of gelatin were added, which were then dispersed at 55° C. for 30 minutes. Thus, an emulsion containing 32 mol % of silver bromide and 68 mol % of silver chloride, and having an average grain size of 0.25 μm and a monodispersity of 9 was obtained.

This emulsion was taken in an amount of 2,600 ml. Then 40 ml of an aqueous 0.1% citric acid and 100 ml of an aqueous 5% potassium bromide solution were added thereto and the pH and pAg were controlled. To the emulsion thus obtained, 20 ml of an aqueous 0.1% sodium thiosulfate and 30 ml of an aqueous 0.1% chloroauric acid solution were added to effect ripening at 60° C. for about 3 hours to give an optimum sensitivity.

To the above emulsion, 25 ml of an aqueous 0.5% solution of 1-phenyl-5-mercaptotetrazole as an antifoggant, 600 ml of an aqueous 1% solution of 4-hydroxy-6-methyl-1,3,3a,7-tetrazaindene as a stabilizer and 960 ml of an aqueous 10% gelatin solution were added, and the ripening was stopped. Thereafter, to the emulsion thus obtained, the following additives were so added as to give the coating weights shown below. The resulting emulsion was coated on a 100 μm thick polyethylene terephthalate support having been subbed with a latex as disclosed in Example 1 in Japanese Patent O.P.I. Publication 19941/1984.

| Additives | |
|---|---|
| Latex polymer (ethyl acrylate/1,1-dichloroethene copolymer) | 0.35 g/m$^2$ |
| Saponin | 140 mg/m$^2$ |
| Hydroquinone | 160 mg/m$^2$ |
| Styrene/maleic acid copolymer | 70 mg/m$^2$ |
| Silver weight | 44.5 mg/m$^2$ |

Next, an emulsion layer protective film coating solution with the following formulation was prepared, and coated simultaneously together with the emulsion.

| Emulsion layer protective film (outermost layer) coating solution | |
|---|---|
| Matting agent (polymeric silicon oxide; average particle diameter: 4 μm) | 20 mg/m$^2$ |
| Fluorine-containing surface active agent, shown in Table 1 | 10 mg/m$^2$ |
| Bis-(2-cyclohexyl) sulfosuccinate | 2 mg/m$^2$ |
| Potassium bromide | 20 mg/m$^2$ |
| Alkali-treated gelatin (isoelectric point: 4.9) | 1.4 mg/m$^2$ |
| Formalin | 20 mg/m$^2$ |
| Cyanuric chloride | 50 mg/m$^2$ |

On the other hand, corona discharging was previously applied at a power of 30 W/(m$^2$·min) to the support on its side opposite to the emulsion layer side. Thereafter, poly(styrene-butyl acrylate-glycidyl methacrylate) latex polymer was coated thereon in the presence of a hexamethylene aziridine hardening agent, and the following antistatic layer coating solution was further coated so as to give the coating weights shown below, at a coating speed of 33 mm/min using a roll fit coating pan and an air knife. An antistatic layer was thus formed.

| Antistatic layer coating solution | |
|---|---|
| Water soluble conductive polymer (A) | 0.72 g/m$^2$ |
| Hydrophobic polymer particles (B) | 0.2 g/m$^2$ |
| Polyethylene glycol (Mw: 500) | 0.02 g/m$^2$ |
| Hardening agent (C, Table 2) | 0.2 g/m$^2$ |

After the antistatic layer coating solution was applied, the coating layer was dried at 90° C. for 2 minutes, followed by heat treatment at 140° C. for 90 seconds. A backing layer coating solution with the following formulation was further coated thereon so as for its additives to give the coating weights shown below.

| Backing layer coating solution | |
|---|---|
| Latex polymer (ethyl acrylate/1,1-dichloroethene copolymer | 100 mg/m$^2$ |
| Saponin | 20 mg/m$^2$ |
| 5-Nitroindazole | 50 mg/m$^2$ |
| Matting agent (citric acid) | 10 mg/m$^2$ |
| Backing dye (a) | 100 mg/m$^2$ |
| Backing dye (b) | 30 mg/m$^2$ |
| Backing dye (c) | 100 mg/m$^2$ |
| Alkali-treated gelatin | 2.5 mg/m$^2$ |
| Glyoxal | 10 mg/m$^2$ |
| Compound M | 50 mg/m$^2$ |

Backing Layer Protective Film (Outermost Layer)

A backing layer protective film coating solution with the following formulation was prepared and simultaneously coated on the backing layer so as for its additives to give the coating weights shown below. Samples No. 1 to No. 17 were thus produced.

| Backing layer protective film coating solution | |
|---|---|
| Bis-(2-cyclohexyl) sulfosuccinate | 2 mg/m$^2$ |
| Fluorine-containing surface active agent, shown in Table 1 | 15 mg/m$^2$ |
| Matting agent (polymethyl methyl methacrylate; average particle diameter: 4.0 μm) | 40 mg/m$^2$ |
| Alkali-treated gelatin | 1.0 mg/m$^2$ |

-continued

| Backing layer protective film coating solution | |
|---|---|
| Glyoxal | 20 mg/m$^2$ |

The pH of the above coating solution was adjusted to 5.4 before coating.

Backing dye (a)

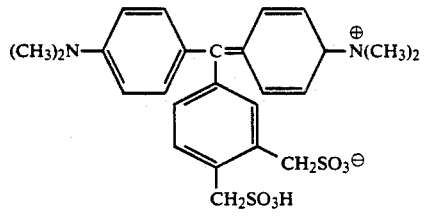

Backing dye (b)

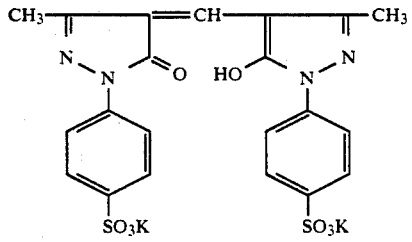

Backing dye (c)

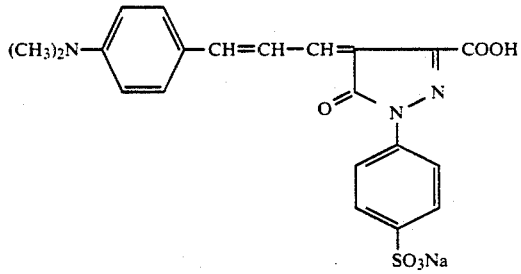

Compound M

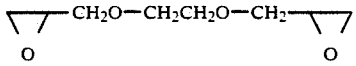

With regard to the samples No. 1 to 17 of the light-sensitive materials thus obtained, transport performance in an automatic transport apparatus was evaluated, using undeveloped samples. Using also the developing solution and fixing solution as shown below, the samples were processed using an automatic processor GR-27 (trade name; manufactured by Konica Corporation), and thereafter the antistatic properties were examined.

| | Processing conditions | |
|---|---|---|
| Steps | Temperature | Time |
| Developing | 38° C. | 20 seconds |
| Fixing | 28° C. | 20 seconds |
| Washing | Room temp. | 20 seconds |

| Formulation of developing solution | |
|---|---|
| (Composition A) | |
| Pure water (ion-exchanged water) | 150 ml |
| Disodium ethylenediaminetetraacetate | 2 g |
| Diethylene glycol | 50 g |
| Potassium sulfite (aqueous 55% w/v solution) | 100 ml |
| Potassium carbonate | 50 g |
| Hydroquinone | 15 g |
| 5-Methyl benzotriazole | 200 mg |
| 1-Phenyl-5-mercaptotetrazole | 30 mg |
| Potassium hydroxide in the amount required for adjusting the pH of the solution used, to 10.4 | |
| Potassium bromide | 4.5 g |
| (Composition B) | |
| Pure water (ion-exchanged water) | 3 ml |
| Diethylene glycol | 50 g |
| 1-Phenyl-3-pyrazolidone | 500 mg |
| Disodium ethylenediaminetetraacetate | 25 mg |
| Acetic acid (aqueous 90% solution) | 0.3 ml |
| 5-Nitroindazole | 110 mg |

When the developing solution was used, the above composition A and composition B were dissolved in this order in 500 ml of water, and made up to 1 liter.

| Formulation of fixing solution | |
|---|---|
| (Composition A) | |
| Ammonium thiosulfate (aqueous 72.5% w/v solution) | 240 ml |
| Sodium sulfite | 17 g |
| Sodium acetate trihydrate | 6.5 g |
| Boric acid | 6 g |
| Sodium citrate dihydrate | 2 g |
| Acetic acid (aqueous 90% w/v solution) | 13.6 ml |
| (Composition B) | |
| Pure water (ion-exchanged water) | 17 ml |
| Sulfuric acid (aqueous 50% w/w solution) | 4.7 g |
| Aluminum sulfate (aqueous solution containing 8.1% w/v of aluminum in terms of $Al_2O_3$) | 26.5 g |

When the fixing solution was used, the above composition A and composition B were dissolved in this order in 500 ml of water, and made up to 1 liter. This fixing solution had a pH of about 4.3.

The undeveloped samples obtained were divided into two groups, one of which were stored at 23° C. and 55% RH for 3 days. The other remaining samples were moisture-conditioned at 23° C. and 55% RH for 3 hours, and thereafter enclosed in a moisture-proof bag in the state they were superposed one another, which were then stored at 55° C. for 4 days to make them undergo accelerated aging. Samples for aging were thus prepared. Both of these samples were exposed to light using an optical wedge, and then processed in the same manner as the method previously described, to compare their sensitivities.

Evaluation of Transport Performance in Automatic Transport Apparatus

The transport performance was evaluated using a scanner SG-747RU, manufactured by Dainippon Screen Mfg. Co., Ltd. Samples with a size of 609 mm×812 mm were automatically transported therethrough. An instance where a sample was normally wound around its exposure cylinder was evaluated as "A", and an instance where it was not normally wound around, as "C"

Evaluation of Antistatic Properties

Regarding the antistatic properties, test pieces having been processed were each rubbed 10 times with a Neoprene rubber roller. A piece of paper with a diameter of 5 mm was held up over this-test piece, and the degree of attraction of the paper to the test piece was evaluated according to a five-rank system. A best instance, i.e., an instance where the paper is not attracted, was evaluated as "5", and a worst instance, as rank "1".

TABLE 2

| Sample No. | Water-soluble conductive polymer A | Hydrophobic polymer B | Hardening agent C | Fluorine-containing surface active agent F: Emulsion layer protective film | Fluorine-containing surface active agent F: Backing layer protective film |
|---|---|---|---|---|---|
| 1 | — | 3 | 1 | 1 | 1 |
| 2 | 3 | — | 1 | 1 | 1 |
| 3 | 3 | 3 | — | 1 | 1 |
| 4 | 3 | 3 | 1 | — | 1 |
| 5 | 3 | 3 | 1 | 1 | 1 |
| 6 | 3 | 3 | 1 | 4 | 1 |
| 7 | 3 | 17 | 1 | 6 | 2 |
| 8 | 3 | 23 | 1 | 9 | 3 |
| 9 | 3 | 9 | 1 | 50 | 4 |
| 10 | 3 | 9 | 1 | 51 | 7 |
| 11 | 3 | 9 | 1 | 24 | 8 |
| 12 | 3 | 9 | 1 | 40 | 10 |
| 13 | 3 | 9 | 4 | 40 | 10 |
| 14 | 20 | 9 | 4 | 40 | 10 |
| 15 | 33 | 17 | 4 | 40 | 10 |
| 16 | A | 17 | 4 | 9 | 1 |
| 17 | B | 17 | 4 | 9 | 1 |

A: Fine $SnO_2$ particles with an average particle diameter of 0.02 μm, doped with antimony are coated in a weight of 0.5 g/m$^2$.

B: Fine $SnO_2$ particles with an average particle diameter of 0.03 μm, doped with indium are coated in a weight of 0.5 g/m$^2$.

TABLE 3

| Sample No. | Antistatic properties | Transport performance in transport apparatus | Relative sensitivity: Storage I | Relative sensitivity: Storage II |
|---|---|---|---|---|
| 1 (X) | C | A | 100 | 30 |
| 2 (X) | C | A | 100 | 45 |
| 3 (X) | C | A | 100 | 45 |
| 4 (Y) | A | C | 105 | 70 |
| 5 (Y) | A | A | 105 | 99 |
| 6 (Y) | A | A | 103 | 98 |
| 7 (Y) | A | A | 105 | 100 |
| 8 (Y) | A | A | 103 | 100 |
| 9 (Y) | A | A | 102 | 98 |
| 10 (Y) | A | A | 105 | 103 |
| 11 (Y) | A | A | 103 | 99 |
| 12 (Y) | A | A | 105 | 102 |
| 13 (Y) | A | A | 102 | 99 |
| 14 (Y) | A | A | 105 | 102 |
| 15 (Y) | A | A | 102 | 99 |
| 16 (Y) | A | A | 100 | 97 |
| 17 (Y) | A | A | 100 | 97 |

X: Comparative Example. Y: Present Invention

Storage I

Measured after storage at 23° C., 55% RH for 3 days.

Storage II

Measured after storage in a moisture-proof bag at 55° C. for 4 days after moisture conditioning at 23° C., 55% RH for 3 days.

As is clear from the results shown in Table 3, the samples Nos. 1 to 3 to which none of the water-soluble conductive polymer, hydrophobic polymer particles and hardening agent are added are not preferable since they show a poor antistatic properties and great sensitivity variations due to storage. In the samples in which those are simultaneously added show good antistatic properties, but tend to show poor transport performance in the transport apparatus. On the other hand, the samples according to the present invention in which the fluorine-containing surface active agent is further used together with the above components, show good results on all the antistatic properties, sensitivity variations due to storage, transport performance in the transport apparatus.

What is claimed is:

1. A silver halide photographic light-sensitive element comprising a support and provided thereon a conductive layer containing a water-soluble polymer or a metal oxide and at least one surface active agent containing a fluorine atom is contained in a protective layer selected from a protective layer of a silver halide emulsion layer or a protective layer of a backing layer, wherein said surface active agent containing a fluorine atom is represented by Formulae Fa, Fb, Fc, Fd or Fc,

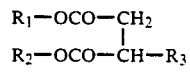

Formula Fa

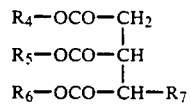

Formula Fb wherein $R_1$, $R_2$, $R_4$, $R_5$ and $R_6$ each represent a straight-chain or branched alkyl group having 1 to 32 carbon atoms, which may also be an alkyl group that forms a ring, at least one group of $R_1$ and $R_2$ and at least one group of $R_4$, $R_5$ and $R_6$ are each substituted with at least one fluorine atom, $R_1$, $R_2$, $R_4$, $R_5$ and $R_6$ may also each represent an aryl group as exemplified by a phenyl group and a naphthyl group, in these aryl groups, at least least one group of $R_1$ and $R_2$ and at least one group of $R_4$, $R_5$ and $R_6$ are each substituted with a group substituted with at least one fluorine atom, $R_3$ and $R_7$ each represent a carboxylato group, a sulfonato group or an acid group, Formula Fc

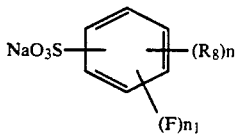

wherein $R_8$ represent an alkyl group having 1 to 32 carbon atoms, these groups are each substituted with at least one fluorine atom, n is an integer of 1 to 3, and $n_1$ is an integer of 0 to 4, formula Fd

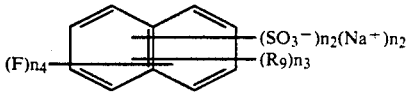

wherein $R_9$ represents a saturated or unsaturated straight-chain or branched alkyl group having 1 to 32 carbon atoms, these saturated or unsaturated alkyl groups are each substituted with at least one fluorine atom, $n_2$ and $n_3$ each represent an integer of 1 to 3, and $n_4$ is an integer of 0 to 6,

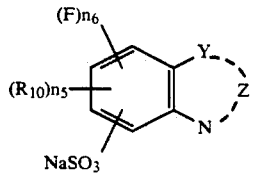

Formula Fe wherein Y represents a sulfur atom, a selenium atom, an oxygen atom, a nitrogen atom or a group —N($R_{11}$)—, wherein $R_{11}$ represents a hydrogen atom or an alkyl group having 1 to 3 carbon atoms, $R_{10}$ represents a group having the same definition as the group represented by $R_8$ in Formula Fc, or an aryl group, substituted with at least one fluorine atom, Z represents a group of atoms necessary to complete a hetero ring of 5 or 6 members, the above hetero ring may further have a substituent such as an alkyl group or aryl group, and on these substituents each a fluorine atom may be substituted.

2. The material of claim 1, wherein said photographic component layer comprises at least one silver halide light-sensitive emulsion layer and at least one nonsensitive protective outermost layer.

3. The material of claim 2, wherein said conductive layer is formed between said silver halide light-sensitive emulsion layer and said support.

4. The material of claim 2, wherein said conductive layer is formed on the support side opposite to said silver halide light-sensitive emulsion layer.

5. The material of claim 2, wherein said conductive layers are formed on the both sides of said support.

6. The material of claim 2, wherein the outermost layer formed on the opposite sides of said support, has a fluorine-containing surface active agent.

7. The material of claim 2, wherein the outermost layer formed on the support side provided thereon said silver halide light-sensitive emulsion layer, has a fluorine-containing surface active agent.

8. The material of claim 2, wherein said conductive layer comprises a hydrophobic polymer particle and a hardener.

9. The material of claim 2, wherein, said conductive layer comprises a metal oxide.

10. The element of claim 1, wherein $R_1$, $R_2$, $R_4$, $R_5$ and $R_6$ each represent a methyl group, an ethyl group, a butyl group, an isopropyl group, a pentyl group, a hexyl group, an octyl group, at least one group of $R_1$ and $R_2$ and at least one group of $R_4$, $R_5$ and $R_6$ are each substituted with at least one fluorine atom, $R_1$, $R_2$, $R_4$, $R_5$ and $R_6$ may also each represent an aryl group selected from the group consisting of a phenyl group and a naphthyl group, in these aryl groups, at least one group of $R_1$ and $R_2$ and at least one group of $R_4$, $R_5$ and $R_6$ are each substituted with a group substituted with at least one fluorine atom, $R_3$ and $R_7$ each represent a carboxylato group, a sulfonato group or a phosphoric acid group, $R_8$ represents a methyl group, an ethyl group, a propyl group, a hexyl group, a nonyl group, a dodecyl group or a hexadecyl group, these groups are each substituted with at least one fluorine atom, $R_9$ represents a methyl group, an ethyl group, a butyl group, an isopropyl group, a hexyl group, a dodecyl group, an octadecyl group, a butenyl group or an octenyl group, these groups are each substituted with at least one fluorine atom, $R_{11}$ represents a hydrogen atom, a methyl group or an ethyl group, $R_{10}$ represents a group having the same definition as the group represented by $R_8$ in Formula Fc, a phenyl group or an naphthyl group, substituted with at least one fluorine atom, Z represents a group of atoms necessary to complete a hetero ring of 5 or 6 members selected from the group consisting of a thiazole ring, a selenazole ring, an oxazole ring, an imidazole ring, a pyrazole ring, a triazole ring, a tetrazole ring, a pyrimidine ring and a triazine ring, the above hetero ring may further have an alkyl group or aryl group substituent, and on these substituents each a fluorine atom may be substituted.

* * * * *